US009299514B2

(12) United States Patent
Ulomek

(10) Patent No.: US 9,299,514 B2
(45) Date of Patent: Mar. 29, 2016

(54) ELECTRICAL SWITCH

(75) Inventor: Peter Ulomek, Radevormwald (DE)

(73) Assignee: HUF HULSBECK & FURST GMBH & CO. KG (DE)

( * ) Notice: Subject to any disclaimer, the term of this patent is extended or adjusted under 35 U.S.C. 154(b) by 46 days.

(21) Appl. No.: 12/837,147

(22) Filed: Jul. 15, 2010

(65) Prior Publication Data

US 2011/0011709 A1 Jan. 20, 2011

(30) Foreign Application Priority Data

Jul. 15, 2009 (DE) ..... 20 2009 013 098 U
Nov. 13, 2009 (DE) ..... 10 2009 046 704

(51) Int. Cl.
*H01H 13/78* (2006.01)
*H01H 23/06* (2006.01)

(52) U.S. Cl.
CPC ..... *H01H 13/78* (2013.01); *H01H 2205/016* (2013.01); *H01H 2205/024* (2013.01); *H01H 2205/028* (2013.01); *H01H 2215/012* (2013.01)

(58) Field of Classification Search
CPC ..... H01H 23/06; H01H 23/16; H01H 23/18; H01H 23/23; H01H 13/70
USPC ..... 200/238, 314, 341, 406, 512–520
See application file for complete search history.

(56) References Cited

U.S. PATENT DOCUMENTS 4,343,973 A 8/1982 Main
4,400,596 A * 8/1983 Fukukura et al. ..... 200/5 A
4,438,304 A 3/1984 Kennedy
4,739,127 A 4/1988 Higuchi
5,453,589 A 9/1995 Mayer
6,333,477 B1 12/2001 Koyama
6,423,918 B1 * 7/2002 King et al. ..... 200/406
2011/0278144 A1 * 11/2011 Ulomek ..... 200/302.2

FOREIGN PATENT DOCUMENTS

CN 101454529 A 6/2009
DE 0356706 3/1990

(Continued)

OTHER PUBLICATIONS

JP OA Patent Application No. 2010-160054 dated Apr. 22, 2014.

(Continued)

*Primary Examiner* — Amy Cohen Johnson
*Assistant Examiner* — Marina Fishman
(74) *Attorney, Agent, or Firm* — Cantor Colburn LLP

(57) ABSTRACT

The invention concerns an electrical switch with a contact system arranged within a housing, which has fixed contact elements and a switch contact element, an operating device for switching action on the contact system, in which, via elastic deformation of the switch contact element, the switch contact element can be brought into a rest position and into a switching position, the fixed contact elements being galvanically separated from each other in the rest position contactless relative to each other and the fixed contact elements being electrically connected to each other in the switching position via the switch contact element, such that the switch contact element has a switching section and a fastening section, the fastening section being spaced from the switching section, the switching section serving for electrical connection of the fixed contact elements and the fastening section guaranteeing reliable fastening of the switch contact element in housing.

18 Claims, 2 Drawing Sheets

(56) References Cited

FOREIGN PATENT DOCUMENTS

| | | | |
|---|---|---|---|
| DE | 19803560 | | 8/1999 |
| DE | 19823894 | C1 | 1/2000 |
| DE | 19834017 | | 2/2000 |
| DE | 19901799 | | 7/2000 |
| DE | 20017078 | | 3/2001 |
| DE | 102005001371 | | 7/2006 |
| DE | 102005037613 | | 2/2007 |
| DE | 102006024292 | A1 | 11/2007 |
| DE | 102009033486 | | 4/2010 |
| JP | 55-114136 | | 1/1980 |
| JP | 61-101913 | | 6/1986 |
| JP | 2002175736 | | 6/2002 |

OTHER PUBLICATIONS

CN OA 2010102302370 dated Feb. 11, 2014.

CN 2nd Office Action, Applilcation No. 2010102302370 dated Sep. 3, 2014, with English Translation.

* cited by examiner

III-III

ELECTRICAL SWITCH

TECHNICAL FIELD

The invention concerns an electrical switch with a contact system arranged within a housing, having fixed contact elements and a switch contact element, an operating device for switching action on the contact system, in which the switch contact element can be brought by elastic deformation of the switch contact element into a rest position and a switching position, the fixed contact elements being galvanically separated from each other in the rest position and the fixed contact elements being electrically connected to each other via the switch contact element in the switching position.

BACKGROUND

A switch is disclosed in DE 10 2008 049 580.8, which has a contact system arranged within a housing. The contact system consists, among other things, of fixed contact elements, as well as a switch contact element designed as a snap disk. By manual operation of the operating device of the switch, elastic deformation of the snap disk can be produced, so that the fixed contact elements are electrically connected to each other. The snap disk is fastened on the housing by a separate component.

BRIEF SUMMARY

The task of the present invention is to devise an electrical switch configured so that the overall design is simplified and, at the same time, the assembly suitability of the individual components of the electrical switch is improved.

For this purpose, it is proposed according to the invention that the switch contact element have a switching section and a fastening section, the fastening section being spaced from the switching section and the switching section serving for electrical connection of the fixed contact elements and the fastening section guaranteeing reliable fastening of the switch contact element in the housing.

One of the essential advantages of this invention is that the switch contact element has two zones that are separated from each other. The first zone is the switching section and the second zone the fastening section. A certain contacting of the fixed contact elements occurs over the switching section. The fastening section has its main tasks of holding the switch contact element reliably within the housing of the electrical switch. The two mentioned zones are spaced from each other, especially spaced from each by a free space. No separate retaining element, which must fix the switch contact element within the housing, is necessary. An additional component is not necessary, so that much faster and cost-effective production can be attained.

In one possible variant of the invention, the switch contact element can have at least one connection section that connects the switching section to the fastening section. The switch contact element can form a monolithic component with the switching section and/or the fastening section and/or the connection section. In one possible embodiment of the electrical switch, the switch contact element is designed as a material unit with the switching section, the fastening section and the connection section. It is also conceivable that the mentioned sections do form a common component, but comprise different materials. In a preferred embodiment of the electrical switch, the switch contact element is a metal stamping.

The connection section can preferably be geometrically designed, so that during the change between the rest position and the switching position of the switch contact element, an elastic deformation of the fastening section is prevented. In order for reliable fastening of the switch contact element to be guaranteed, it is advantageous that during the change between the rest position and the switching position of the switch contact element, an elastic deformation does not occur on the fastening section, which would disadvantageously be connected with a certain movement or displacement of the switch contact element and might therefore adversely affect functioning of the contact system. The elastic deformation according to the invention, during the action of the operating device on the contact system, is "trapped" and filtered out by the connection section, starting from the switching section, so that the fastening section during the change between the rest position and switching position of the switch contact element remains rigid and unmoving in its position.

The connection section of the switch contact element is preferably designed as a thin connector. In order to take up the elastic deformation of the switching section as reliably as possible, the connection section can be designed elastic.

In one variant of the electrical switch, the fastening section can be connected to the housing in shape-mated and/or press-fit fashion or bonded. In particular, the fastening section is fastened to the housing by a snap-in connection. A clip connection is conceivable, for example, through which the fastening section can be reliably fastened to the housing.

In one conceivable variant, the fastening section can have an opening, in which a protrusion-like base of the housing is accommodated, so that reliable fastening of the switch contact element is attainable. The fastening section can also have at least one retaining element on the opening, in which the retaining element in the installed state of the switch contact element is elastically deformed on the housing and lies against the base.

While the installer fastens the switch contact element on the housing, elastic deformation of the retaining element or elements occurs, so that the geometric size of the opening is enlarged. The base of the housing passes through the opening during the assembly process, in which case the outer wall of the base simultaneously elastically deforms the retaining element or elements. In the fastened state, the retaining element, with its free end, can engage slightly in the material of the base, which is preferably made of plastic. Additional improvement of fastening of the switch contact element on the housing is achieved by this.

The operating device is advantageously operable manually from the outside, especially if a lifter element is provided on the operating device within the housing. The operating device, as well as the lifter element, can be made as a common component.

The switch contact element is advantageously a hard metal plate. The switching section can be designed in this case as an arched element. Through the pressure force of the lifter, the switch contact element arches in the direction of the fixed contact element and reaches the switching position, in which the switch contact element connects the fixed contacts to each other electrically. Electrical contact between the fixed contact elements is produced by this.

A restoring force advantageously acts on the operating device, which always attempts to move the restoring device into its initial position, in which the switch contact element is simultaneously in the rest position. For example, the restoring force can start, among other things or alone, from the switch contact element, which seeks to return abruptly to its pre-arched initial position, which is the rest position, when operating force on the operating device is released. It is also conceivable that the restoring source is generated via a spring element that supports the restoring process of the operating device. In order to protect the switch contact element from powerful overload, the electrical switch can have limitation devices within the housing that restrict the deflection movement of the operating device.

The present invention also pertains to an operating unit of a moving part of a vehicle, especially a trunk lid, in which the operating unit has the electrical switch.

BRIEF DESCRIPTION OF THE DRAWINGS

Further advantages, features and details of the invention are apparent from the following description, in which a practical example of the invention is described in detail with reference to the drawings. The features mentioned in the claims and description can be essential to the invention individually or in any combination. In the drawings:

DETAILED DESCRIPTION

Figure 1:
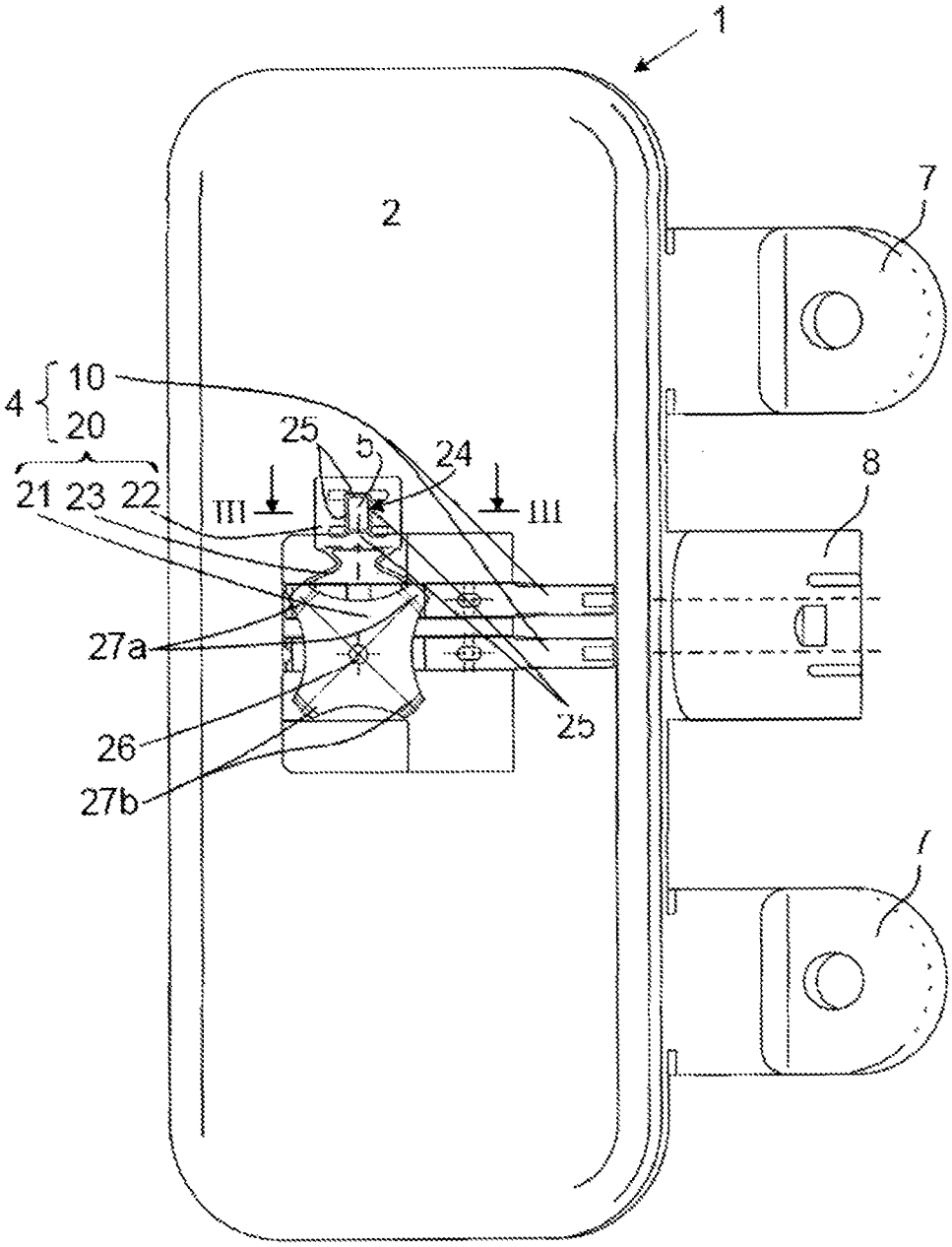
FIG. 1 shows a top view of an electrical switch.

FIG. 1 shows an electrical switch 1, which has a contact system 4, which has two fixed contact elements 10 that run parallel and at a spacing from each other within housing 2. In addition, an elastically deformable switch contact element 20 is fastened to housing 2, the switch contact element 20 having a switching section 21 and a fastening section 22. Between the switching section 21 and the fastening section 22, there is a free space. The switching section 21 is connected via a connection section 23 to the fastening section 22, in which the connection section 23 lies in the free space. The switch contact element 20 forms a monolithic component with the switching section 21 and the fastening section 22, as well as the connection section 23. The switch contact element 20 is a metal stamping in the present practical example.

The switching section 21 in the center has a pressure area 26, as well as four foot areas 27*a*, 27*b*. The foot areas 27*a* together contact one of the two fixed contact elements 10. The foot areas 27*b* of the switching section 21 lie on the plastic housing 2 without contacting the fixed contact elements 10.

Figure 3:
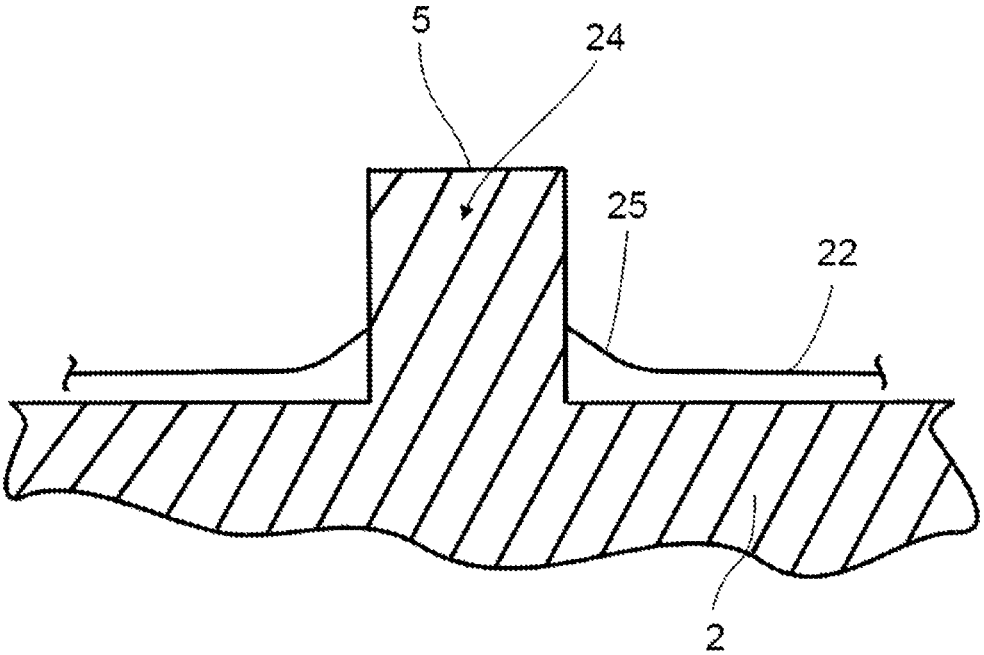
FIG. 3 shows a sectional view according to III-III from FIG. 1.

Fastening of the switch contact element 20 occurs in the area of the fastening section 22. The fastening section 22 has an opening 24. A base 5 of the housing 2 stands within the opening 24. During assembly of the switch contact element 20, the installer positions the fastening section 22 of the switch contact element 20 on base 5. As is apparent from FIG. 1, the fastening section 22 in the area of the opening 24 has several retaining elements 25 that are elastically deformed during the assembly process of the switch contact element 20 on the housing 2 through base 5 and achieve their deformation end position according to FIG. 3. The free ends of the retaining elements 25 penetrate the surface of the plastic base 5 slightly, so that reliable fastening of the fastening section 22 on the housing 2 is attainable.

The fixed contact elements 10 run parallel to each other in the direction of a connection element 8 lying on the outside of housing 2. The connection element 8 in the present practical example is designed sleeve-like. An electrical connection to the fixed contact elements 10 can be achieved on the connection element 8 via a plug. Two fastening devices 7 are provided on the side of the connection element 8, in order to fasten the switch 1 in its overall structure to a not explicitly shown component or object.

Figure 2:
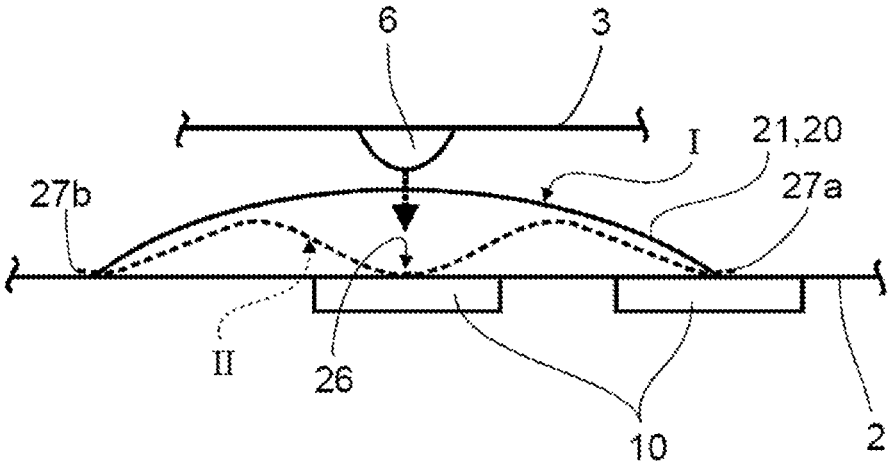
FIG. 2 shows a simplified side view of the switch contact element, which is arranged according to FIG. 1 within the switch.

According to FIG. 2, the electrical switch 1 is equipped with an operating device 3 that can be operated manually. In the present practical example, the operating device 3 has a lifter 6, which extends in the form of a protrusion in the direction of the switch contact element 20. If a desired activation of the operating device 3 now occurs, the lifter 6 presses on the switching section 21 arched in the direction of the operating device 3. The switch contact element 20 is brought from its rest position I into a switching position II, shown with a dashed line, in which the lifter 6 exerts a force on the switching section 21, especially on the pressure area 26, and therefore causes slight elastic deformation of the switching section 21. In the switching position II, the switching section 21 touches the left fixed contact element 10, so that electrical connection of the two fixed contact elements 10 is achieved via the switch contact element 20. In the rest position I, the fixed contact elements 10 are galvanically separated from each other, in which case the switching section 21, with its foot area 27*a*, touches the right fixed contact element 10.

The connection section 23 is designed as a thin connector 23 running from the foot area 27*a* along a curved path to the fastening section 22. In the present practical example, two connectors 23 are arranged that connect the fastening section 22 to the switching section 21. Via the elastic deformation of the switching section 21 during a state change of the switch contact element 20 between the rest position I and the switching position II, the connection section 23 can also be elastically deformed. The connection section 23, however, prevents elastic deformation from being transferred to the fastening section 22.

The electrical switch 1 can be used not only in an operating unit of a moving part of a vehicle, especially a trunk lid. The area of use of the electrical switch includes numerous areas of use familiar to one skilled in the art, in which an electrical switch can find use.

The invention claimed is:

1. An electrical switch with a contact system arranged within a housing, comprising:

fixed contact elements and a switch contact element, an operating device for a switching action on the contact system, in which, by elastic deformation of the switch contact element, the switch contact element can be brought into a rest position and into a switching position, in which the fixed contact elements are galvanically separated from each other in the rest position and the fixed contact elements are electrically connected to each other via the switch contact element in the switching position, wherein the switch contact element has a switching section and a fastening section, in which the fastening section is spaced from the switching section, the switching section serves for electrical connection of the fixed contact elements and the fastening section guarantees reliable fastening of the switch contact element in housing, wherein the switch contact element has at least one connection section that connects the switching section to the fastening section, wherein the connection section is geometrically designed so that during a change between the rest position and the switching position of the switch contact element, elastic deformation of the fastening section is prevented, wherein an elastic deformation, starting from the switching section, is trapped or filtered out by the connection section; and wherein between the switching section and the fastening section a free space is found, in which the connection section lies within the free space, wherein the fastening section has an opening, in which a protrusion-like base of the housing is accommodated, so that reliable fastening of the switch contact element is attainable, and wherein the fastening section has at least one retaining element on the opening, in which the retaining element in the installed state of the switch contact element on the housing is elastically deformed and lies against base.

2. The electrical switch according to claim 1, wherein the switch contact element forms a monolithic component with the switching section and/or the fastening section and/or the connection section.

3. The electrical switch according to claim 1, wherein the connection section is designed as a thin connector.

4. The electrical switch according to claim 1, wherein the connection section is designed elastic.

5. The electrical switch according to claim 1, wherein the switch contact element is a metal stamping.

6. The electrical switch according to claim 1, wherein the fastening section is connected to the housing in shape-mated and/or press-fit fashion or bonded.

7. The electrical switch according to claim 1, wherein the operating device can be operated manually from the outside.

8. The electrical switch according to claim 1, wherein the connection section runs along a curved path from the switching section to the fastening section.

9. An operating unit of a moving part of a vehicle, in which the operating unit has the electrical switch according to claim 1.

10. An electrical switch with a contact system arranged within a housing comprising:

fixed contact elements and a switch contact element, an operating device for a switching action on the contact system, in which, by elastic deformation of the switch contact element, the switch contact element can be brought into a rest position and into a switching position, in which the fixed contact elements are galvanically separated from each other in the rest position and the fixed contact elements are electrically connected to each other via the switch contact element in the switching position, wherein the switch contact element has a switching section and a fastening section, in which the fastening section is spaced from the switching section, the switching section serves for electrical connection of the fixed contact elements and the fastening section guarantees reliable fastening of the switch contact element in housing, wherein the switch contact element has at least one connection section that connects the switching section to the fastening section, wherein the connection section is designed as a thin connector, wherein an elastic deformation, starting from the switching section, is trapped or filtered out by the connection section; and wherein between the switching section and the fastening section, a free space is found, in which the connection section lies within the free space, wherein the fastening section has an opening, in which a protrusion-like base of the housing is accommodated, so that reliable fastening of the switch contact element is attainable, and wherein the fastening section has at least one retaining element on the opening, in which the retaining element in the installed state of the switch contact element on the housing is elastically deformed and lies against base.

11. The electrical switch according to claim 10, wherein the switch contact element forms a monolithic component with the switching section and/or the fastening section and/or the connection section.

12. The electrical switch according to claim 10, wherein the connection section is geometrically designed so that during a change between the rest position and the switching position of the switch contact element, elastic deformation of the fastening section is prevented.

13. The electrical switch according to claim 10, wherein the connection section is designed elastic.

14. The electrical switch according to claim 10, wherein the switch contact element is a metal stamping.

15. The electrical switch according to claim 10, wherein the fastening section is connected to the housing in shape-mated and/or press-fit fashion or bonded.

16. The electrical switch according to claim 10, wherein the operating device can be operated manually from the outside.

17. The electrical switch according to claim 10, wherein the connection section runs along a curved path from the switching section to the fastening section.

18. An operating unit of a moving part of a vehicle, in which the operating unit has the electrical switch according to claim 10.

* * * * *